US010179979B1

(12) United States Patent
Tamisiea

(10) Patent No.: US 10,179,979 B1
(45) Date of Patent: Jan. 15, 2019

(54) BRIDGE SPAN AND METHODS OF MOVING A BRIDGE SPAN

(71) Applicant: Tidy Site Services, LLC, Waukee, IA (US)

(72) Inventor: Reid Tamisiea, Waukee, IA (US)

(73) Assignee: Tidy Site Services, LLC, Waukee, IA (US)

( * ) Notice: Subject to any disclaimer, the term of this patent is extended or adjusted under 35 U.S.C. 154(b) by 0 days.

(21) Appl. No.: 15/647,429

(22) Filed: Jul. 12, 2017

(51) Int. Cl.

| | |
|---|---|
| ***E01D 15/12*** | (2006.01) |
| ***E01D 4/00*** | (2006.01) |
| ***E01D 15/127*** | (2006.01) |
| *E01D 101/30* | (2006.01) |

(52) U.S. Cl.
CPC ..... *E01D 15/127* (2013.01); *E01D 4/00* (2013.01); *E01D 15/12* (2013.01); *E01D 2101/30* (2013.01)

(58) Field of Classification Search
CPC ..... E01D 15/133; E01D 15/12; E01D 15/127; E01D 4/00; E01D 2101/30; E02D 17/10; E01C 9/083
See application file for complete search history.

(56) References Cited

U.S. PATENT DOCUMENTS

| | | | | |
|---|---|---|---|---|
| 227,834 | A * | 5/1880 | Quinby | B65G 69/30 14/69.5 |
| 907,902 | A | 12/1908 | Skinner | |
| 2,294,550 | A | 9/1942 | Greulich | |
| 2,296,779 | A | 9/1942 | Emerson | |
| 3,374,497 | A * | 3/1968 | Meheen | E01D 21/06 14/26 |
| 3,768,108 | A * | 10/1973 | Wadsworth | E01D 4/00 14/24 |
| 3,820,912 | A | 6/1974 | Hughes | |
| 4,534,079 | A * | 8/1985 | Tucker | E01D 15/124 14/14 |
| 4,681,482 | A | 7/1987 | Bernhard et al. | |

(Continued)

FOREIGN PATENT DOCUMENTS

| | | |
|---|---|---|
| CN | 204311338 U | 5/2015 |
| CN | 204401393 U | 6/2015 |

(Continued)

OTHER PUBLICATIONS

"Remagen Man Portable Bridge from Tactical & Rescue Gear," Soldier Systems Daily, Retrieved online from <http://soldiersystems.net/2009/04/15/remagen-man-portable-bridge-from-tactical-rescue-gear/> on Sep. 1, 2015, 2 pages.

(Continued)

*Primary Examiner* — Abigail A Risic
(74) *Attorney, Agent, or Firm* — Fredrikson & Byron, P.A.

(57) ABSTRACT

A bridge span assembly can include multiple bridge spans, each of which can include a frame, a stabilizing member for engaging with construction equipment, and a coupling joint for attaching the frame to construction equipment with an elongate member. By attaching the bridge span assembly to construction equipment with the stabilizing member and coupling joint, an operator can place the bridge span assembly over an obstacle using only the construction equipment. The construction equipment or other equipment can then safely traverse the obstacle without causing damage to the obstacle or the construction equipment.

9 Claims, 9 Drawing Sheets

(56) References Cited

U.S. PATENT DOCUMENTS

| | | | | |
|---|---|---|---|---|
| 4,710,149 | A * | 12/1987 | Prusman | A63H 17/00 446/425 |
| 4,839,935 | A * | 6/1989 | Calcagni | E01D 4/00 14/24 |
| 4,853,998 | A * | 8/1989 | Bernard | E01D 15/127 14/14 |
| 5,042,101 | A * | 8/1991 | Huether | E01D 15/124 14/2.4 |
| 6,616,383 | B2 | 9/2003 | Janz | |
| 7,240,387 | B1 * | 7/2007 | Berggren | E01D 4/00 14/2.4 |
| 7,811,028 | B1 | 10/2010 | de la Rosa et al. | |
| 8,069,592 | B2 | 12/2011 | Ellett | |
| 8,827,173 | B2 | 9/2014 | Nutzati | |
| 8,973,195 | B2 * | 3/2015 | Breault | E02D 17/10 14/2.4 |
| 9,011,037 | B2 | 4/2015 | Breault | |
| 2006/0133897 | A1 | 6/2006 | Allard et al. | |
| 2007/0280789 | A1 | 12/2007 | Britten | |
| 2010/0032932 | A1 * | 2/2010 | Hastings | B60P 1/435 280/762 |
| 2011/0229275 | A1 | 9/2011 | Winings et al. | |
| 2012/0063844 | A1 | 3/2012 | Wold | |
| 2012/0096804 | A1 * | 4/2012 | Gutierrez Tenreiro | E01D 4/00 52/742.14 |
| 2012/0321382 | A1 | 12/2012 | Rosier | |
| 2016/0107851 | A1 * | 4/2016 | Leum | B65G 69/30 14/72.5 |

FOREIGN PATENT DOCUMENTS

| | | | |
|---|---|---|---|
| CN | 204551224 | U | 8/2015 |
| KR | 20030081962 | A | 10/2003 |

OTHER PUBLICATIONS

"TRG's M28 'Remagen' Man-Portable Footbridge," Tactical & Rescue Gear, Ltd., Oct. 15, 2008, 1 page.

* cited by examiner

BRIDGE SPAN AND METHODS OF MOVING A BRIDGE SPAN

BACKGROUND

Moving a piece of construction equipment, like a skid loader, around a construction site safely can pose several challenges. There may be existing structures or installations situated between the access site for construction equipment and the construction site, like paved sidewalks or pipes, that are not to be disturbed, for instance by applying the load of the piece of equipment thereon. There may also be obstacles like ditches or holes that the construction equipment would be unable to cross without becoming stuck.

Maneuvering construction equipment so as to avoid such obstacles is challenging. Particularly in small construction projects, it may be undesirable to construct a temporary bridge that would facilitate the access of construction equipment to the construction site safely.

SUMMARY

In general, this disclosure is directed to a bridge span assembly that enables construction equipment to safely traverse an obstacle without causing damage to the obstacle or the construction equipment. The bridge span assembly is designed to be deployed by attaching it directly to the construction equipment that needs to traverse the obstacle. The operator may attach the bridge span assembly to the construction equipment, place the bridge span assembly in the desired location, and detach the bridge span assembly using only the construction equipment. The construction equipment may then safely traverse the obstacle using the bridge span.

The details of one or more examples are set forth in the accompanying drawings and the description below. Other features, objects, and advantages will be apparent from the description and drawings, and from the claims.

DETAILED DESCRIPTION

Figure 1:
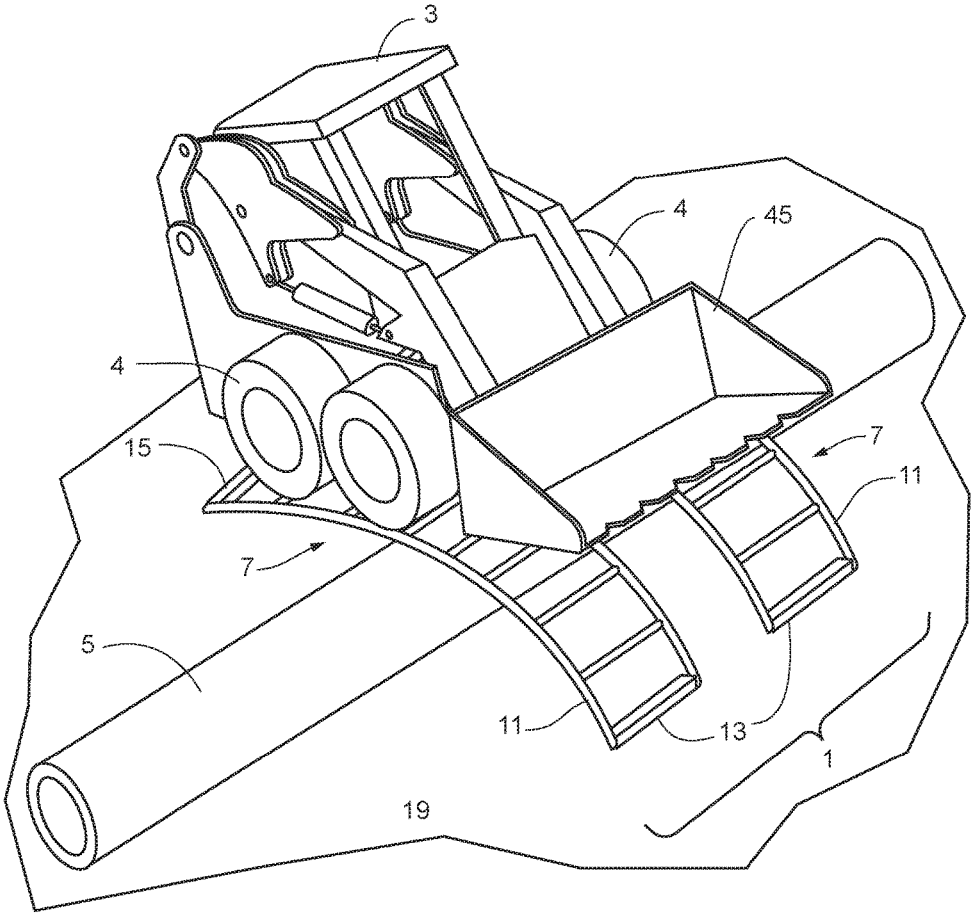
FIG. 1 is a representation of a piece of construction equipment crossing an obstacle using a bridge span assembly.

Disclosed are exemplary embodiments of methods and systems for assembling and deploying a bridge span assembly 1 that enables a piece of construction equipment 3 to cross an obstacle 5 without engaging obstacle 5. FIG. 1 depicts a piece of construction equipment 3 crossing an obstacle 5 using a bridge span assembly 1. An obstacle may be a channel, ravine, creek, or other terrain feature that is difficult for construction equipment 3 to cross, a sidewalk, pipe, or other structure that is already in place, a landscape feature like a flowerbed or other planting, or any other similar structure over which construction equipment may need to traverse. In one embodiment, bridge span assembly 1 includes at least one bridge span 7. In some embodiments, bridge span assembly 1 includes at least two bridge spans 7. The one or more bridge spans 7 may include a frame 11 that extends from a first end 13 to a second end 15. Each end of frame 11 is designed to contact the ground surface 19 on either side of an obstacle 5.

Construction equipment 3 may include, for example, skid loaders, excavators, backhoe loaders, and bulldozers. This equipment may be used in projects such as general construction projects, earthmoving projects, like erosion control or landscaping, and excavations for purposes like pipelaying, Worksite locations may range from residential areas to commercial, industrial, or civil engineering project in urban or remote areas. The method and systems disclosed may be tailored to fit each of these situations. Given this wide array of potential worksites and projects, a portable bridge span assembly 1 would be a practical means of enabling construction equipment 3 to access a construction site without substantial cost or delay. Such a portable bridge span assembly 1 could also be reused with ease, rather than discarded or painstakingly disassembled and reassembled before further use.

Figure 2:
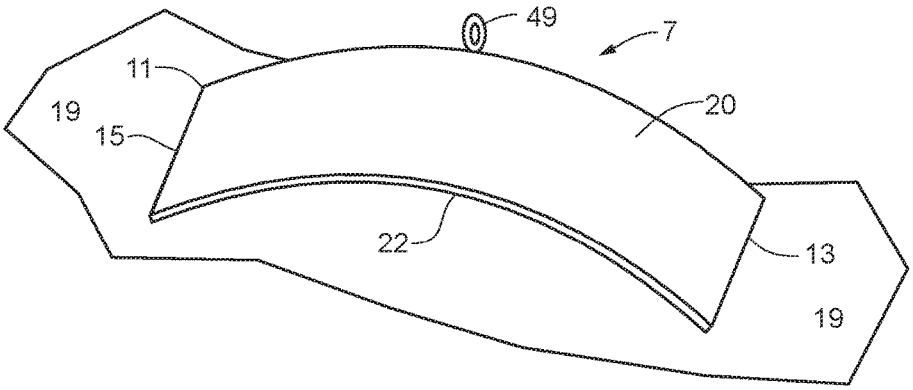
FIG. 2 is a representation of a bridge span with a curved deck surface according to various embodiments.
Figure 3:
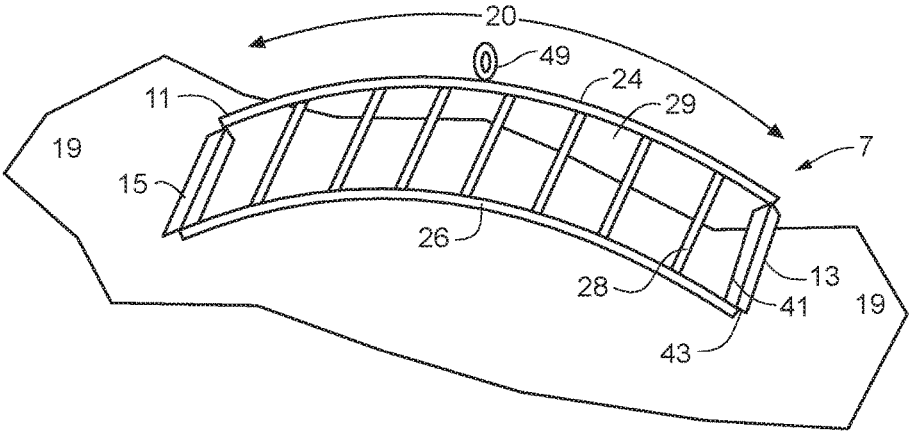
FIG. 3 is a representation of a bridge span with an angled deck surface according to various embodiments.
Figure 4:
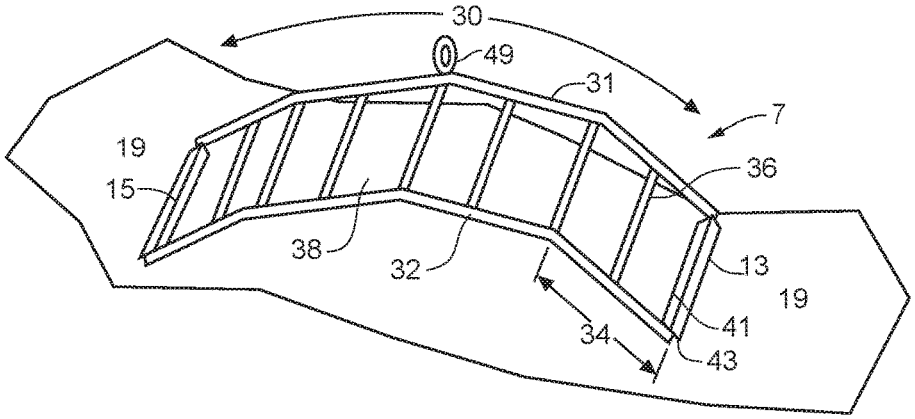
FIG. 4 is a representation of a bridge span with an angled deck surface according to various embodiments.

FIGS. 2-4 show various embodiments of bridge spans 7. Each frame 11 can include a deck surface designed to contact the construction equipment 3 as it crosses the bridge span assembly 1. According to some embodiments, the frame 11 may have a curved deck surface 20 (FIGS. 2-3), such as having a generally continuous curve along the deck, or an angled deck surface 30 (FIG. 4), such as having a series of adjacent, substantially planar segments. In some embodiments, a pad is attached to the first end 13 and the second end 15 of the frame 11. The pad 17 reduces the likelihood that bridge span assembly 1 will damage the surface of an existing structure or landscape feature when placed in a desired location.

FIG. 2 shows a frame 11 with a curved deck surface 20. The curved deck surface 20 may include a curved sheet of metal 22. Utilizing a curved sheet of metal 22 allows for a continuous curved deck surface 20 (e.g., the curvature of the deck surface is continuous along a length of the deck surface) such that construction equipment 3 may traverse it smoothly. However, a curved sheet of metal 22 may not be possible, convenient, or cost-effective for some configurations or types of construction equipment 3. For example, where construction equipment 3 is very large, or the required span of frame 11 very wide, creating a large enough cured sheet of metal 22 may be difficult or cost prohibitive. Similarly, where construction equipment 3 is very heavy, a curved sheets of metal 22 that is thick enough or strong enough to withstand high weights may be expensive or difficult to manufacture.

FIG. 3 shows another bridge span 7. According to some embodiments, a curved deck surface 20 of frame 11 is made from curved rod 24 and curved rod 26, and a series of straight rods 28. The straight rods 28 connect curved rod 24 and curved rod 26. The straight rods 28 may connect perpendicular to curved rod 24 and curved rod 26 and parallel to the other straight rods 28. Configuring curved deck surface 20 out of separate rods provides several advantages, including decreasing weight without substantially affecting stability and reducing manufacturing costs.

FIG. 4 shows a frame 11 with an angled deck surface 30. According to some embodiments, the angled deck surface 30 is made from a first rod 31 and a second rod 32, each with several linear angled sections 34, and a series of straight rods 36. The straight rods 36 connect the first rod 31 and the second rod 32. The straight rods 36 may connect perpendicular to first rod 31 and second rod 32 and parallel to the other straight rods 36.

Referring to FIGS. 1, 3, and 4, the spacing of the rods in a frame 11 of a bridge span 7 can impact how the bridge span 7 is traversed. In embodiments with a curved deck surface 20, the space 29 that the parallel straight rods 28 span is smaller than the diameter of any of the tires 4 of the construction equipment 3. In embodiments with an angled deck surface 30, the space 38 that the parallel straight rods 36 span is smaller than the diameter of any of the tires 4 of the construction equipment 3. This spacing prevents the tires 4 of the construction equipment 3 from becoming stuck in the space 29 between curved rod 24 and curved rod 26 when crossing a curved deck surface 20, or in the space 38 between the first rod 31 and second rod 32 when crossing an angled deck surface 30. The construction equipment 3 is thereby able to traverse the bridge span assembly 1 without becoming immobilized.

Curved deck surfaces 20 or angled deck surfaces 30 may be made from a variety of materials, including fiber-reinforced polymer, structural composites, stainless or carbon steel, wrought iron, or reinforced steel. Materials may be chosen based on the needs of the project, and so through a change in materials, bridge span assembly 1 may be used in many situations. For example, where a lightweight bridge span 7 is needed for easy transport to a remote area, a light, strong metal or fiber-reinforced polymer may be used. Where extremely heavy construction equipment 3 is used, bridge span 7 may instead be made out of reinforced steel.

In some embodiments, a curved deck surface 20 or an angled deck surface 30 of a bridge span assembly 1 is covered with a coating or material. Such a coating or material may include a diamond or carbon coating. The coating or material can aid in preventing slipping of the tires 4 when the construction equipment 3 is traversing a bridge span assembly 1. This assists in the safe operation of construction equipment 3 at a worksite.

Figure 5:
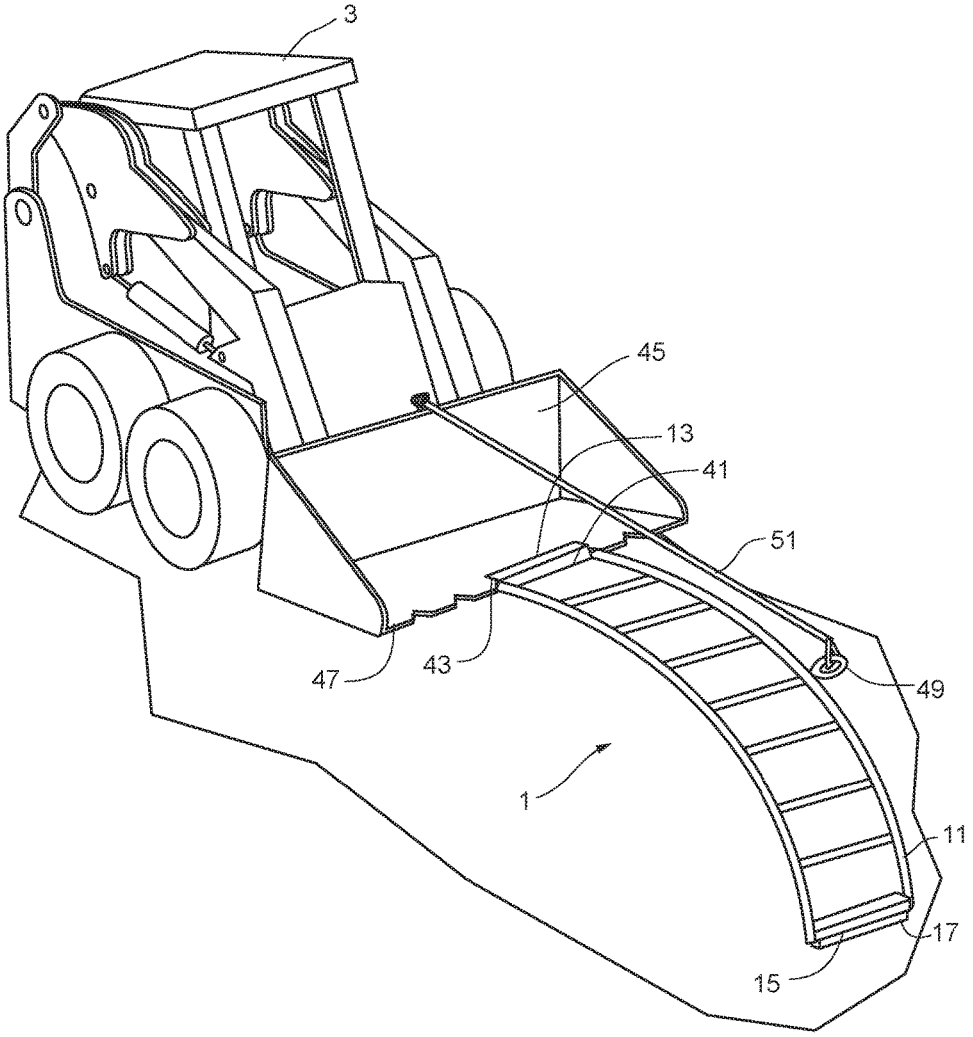
FIG. 5 is a representation of a piece of construction equipment engaging a bridge span according to various embodiments.

Each bridge span 7 can include a stabilizing member 41, affixed to the frame 11 near the first end 13. The stabilizing member 41 is designed to attach to the movable bucket 45 of the construction equipment 3. FIG. 5 depicts a piece of construction equipment 3 engaging the movable bucket 45 with the stabilizing member 41. Once the stabilizing member 41 is attached to the movable bucket 45, the construction equipment 3 is able to raise and lower the bridge span assembly 1.

According to some embodiments, the stabilizing member 41 is a flange 43 that is designed to attach to the lip 47 of the movable bucket 45 on the construction equipment 3. In some embodiments, flange 43 may be configured as a v-shaped notch in the first end 13 or second end 15 of a frame 11, or as a v-shaped protrusion affixed to the first end 13 or second 15 of a frame 11. Configuring flange 43 as a v-shaped notch can provide a stable shape to attach frame 11 to lip 47. A v-shaped notch may also protect a frame 11 by preventing a frame 11 from sliding when a frame 11 is placed on the ground. In some embodiments, flange 43 may be configured as a ridge shape on the first end 13 or second end 15 of a frame 11. A ridge-shaped flange 43 may provide a stable shape to attach to lip 47. By helping to stabilize the frame 11 while it is connected to the movable bucket 45 of construction equipment 3, the flange 43 assists in the secure movement of the bridge span assembly 1.

Each bridge span 7 can include a coupling joint 49. The coupling joint 49 is designed to be attached to an elongated member 51, which can be a chain, a rope, a strap, a metal or plastic support structure, or other suitable elongated member. In certain embodiments, the coupling joint 49 is located at or near the center of the frame 11. In some embodiments, the coupling joint 49 is located nearer to the second end 15 of the frame 11 than the first end 13. The coupling joint 49 may be a hook or loop. The coupling joint 49 may also be a metal projection notched to fit an end of elongated member 51. The coupling joint 49 can be designed to create a stable connection between a frame 11 and an elongated member 51.

FIG. 5 depicts a piece of construction equipment 3 engaging with an elongated member 51. The elongated member 51 attaches to the construction equipment 3, for instance at the movable bucket 45, and the frame 11, for instance at the coupling joint 49. In one embodiment the movable bucket 45 can include a coupling piece for attaching the elongated member 51, while in another embodiment the elongated member 51 can be attached to a pre-existing structure of the movable bucket 45. Once the stabilizing member 41 and the elongated member 51 are attached to the construction equipment 3, the construction equipment 3 may lift the bridge span 7. In the illustrated embodiment, when the movable bucket 45 lifts the first end 13 of the bridge span 7, the elongated member 51 will maintain tension. The tension in elongated member 51 will raise the second end 15 of the bridge span 7, causing the bridge span 7 to be fully lifted. According to some embodiments, the elongated member 51 may be a chain.

The frame 11 may be sized to fit differing types of construction equipment 3. The frame may also be sized to fit differing types and sizes of obstacle. According to some embodiments, the length of frame 11 is more than 7 feet. According to some embodiments, the width of frame 11 is between 18 inches and 30 inches. The width of frame 11 may be designed to accommodate the width of the tires 4 or construction equipment 3. The length of frame 11 may be designed to accommodate the size of an obstacle 5 to be crossed.

Figure 6:
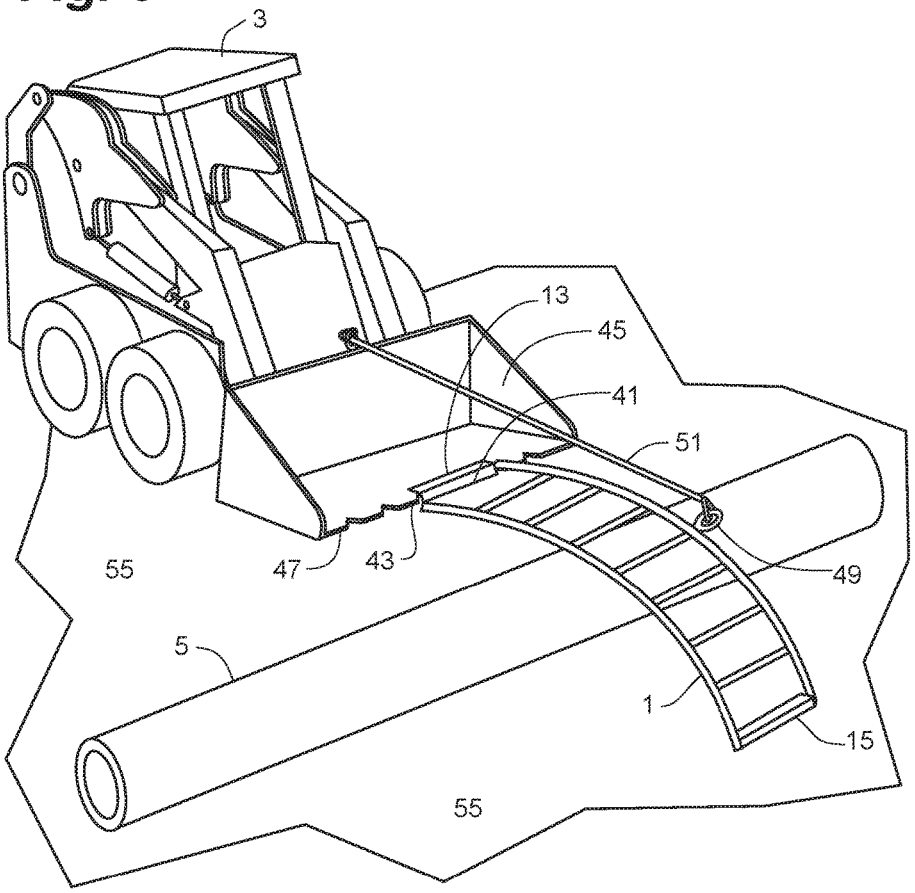
FIG. 6 is a representation of a piece of construction equipment deploying a bridge span.

A method is disclosed for crossing an obstacle 5 with construction equipment 3 using a bridge span assembly 1. Ideally, a portable bridge would be easily deployed by a single user. FIG. 6 depicts a piece of construction equipment 3 deploying a bridge span 7 of bridge span assembly 1. The operator of construction equipment 3 could put the bridge span 7 of bridge span assembly 1 in place, access the construction site, and then exit and remove the bridge spans 7 of bridge span assembly 1. The bridge span assembly 1 would be especially useful in smaller scale projects, so it would help minimize any delays in construction or completion of a project. The ability of a single operator to use bridge span assembly 1 would also reduce costs, because fewer people would be required to perform the work.

Figure 7A:
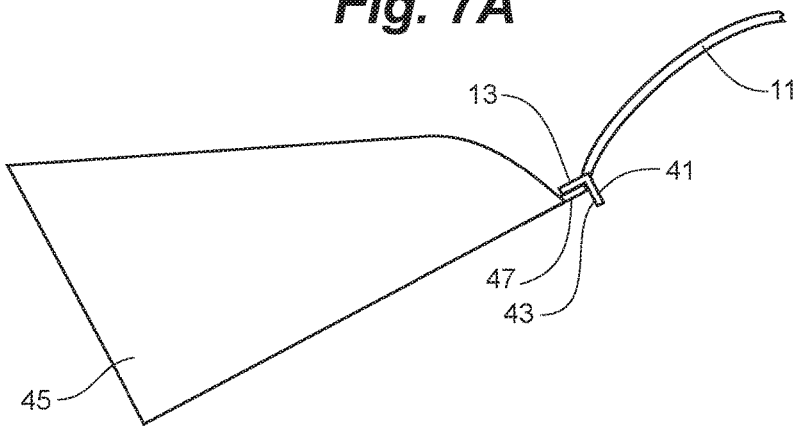
FIG. 7A is a representation of a movable bucket of a piece of construction equipment engaging with a bridge span.
Figure 7B:
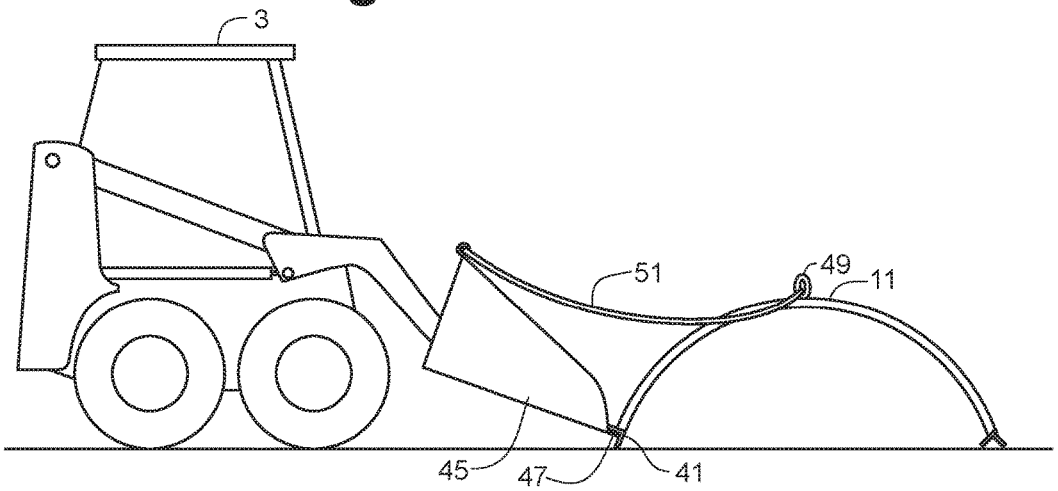
FIG. 7B is a representation of a movable bucket of a piece of construction equipment engaging with a bridge span and an attached elongated member prior to tensioning the elongated member.
Figure 7C:
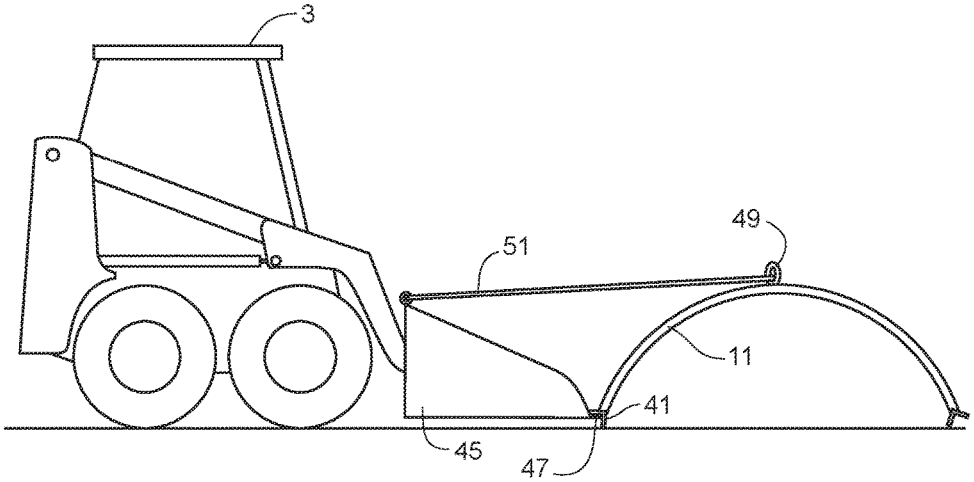
FIG. 7C is a representation of a movable bucket of a piece of construction equipment engaging with a bridge span and an attached elongated member after tensioning the elongated member.

FIG. 5 depicts a piece of construction equipment 3 engaging with a bridge span 7. The construction equipment 3 may couple with the bridge span 7 by coupling the stabilizing member 41 to a movable bucket 45 as shown in FIG. 7A. The construction equipment 3 may also couple with the bridge span 7 by connecting an elongated member 51 to both the coupling joint 49 and the construction equipment 3 as shown in FIG. 7B. Elongated member 51 may be tensioned. Tensioning may be accomplished by tilting the bucket, as shown in FIG. 7C.

Figure 7D:
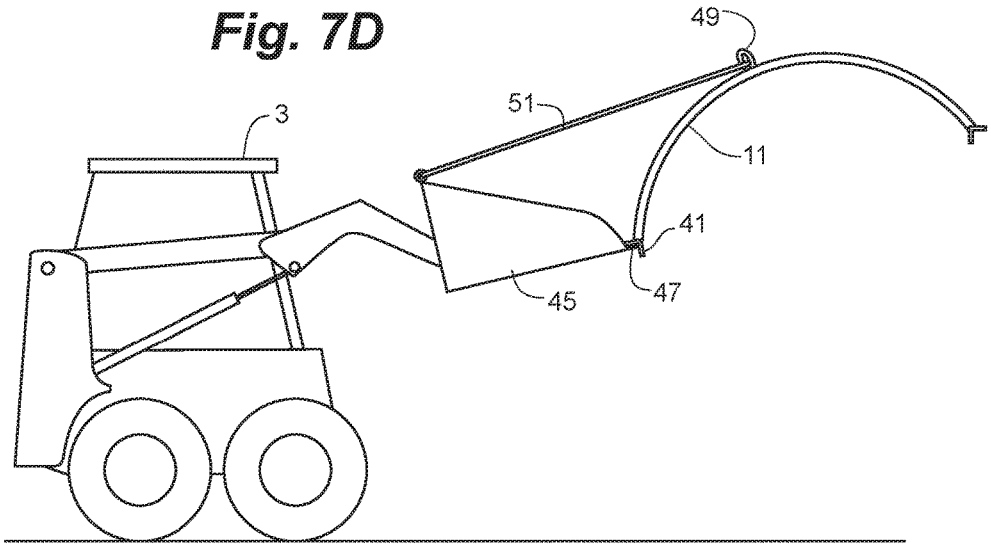
FIG. 7D is a representation of a movable bucket of a piece of construction equipment engaging with a bridge span and an attached elongated member after lifting the movable bucket.

The construction equipment 3 may then lift the bridge span 7. It may do so, as shown in FIG. 7D, by keeping tension in the elongated member 51 and raising the movable bucket 45. Upon raising the movable bucket 45, attached stabilizing member 41 may also be lifted. This lifts the first end 13 and the second end 14 of the bridge span 7.

Figure 7E:
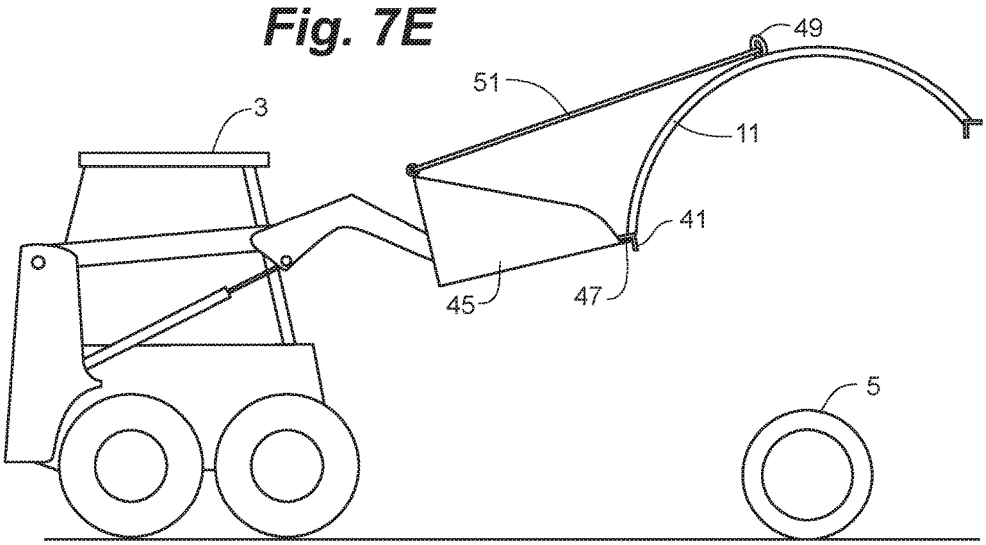
FIG. 7E is a representation of a movable bucket of a piece of construction equipment engaging with a bridge span and an attached elongated member after moving to an obstacle.
Figure 7F:
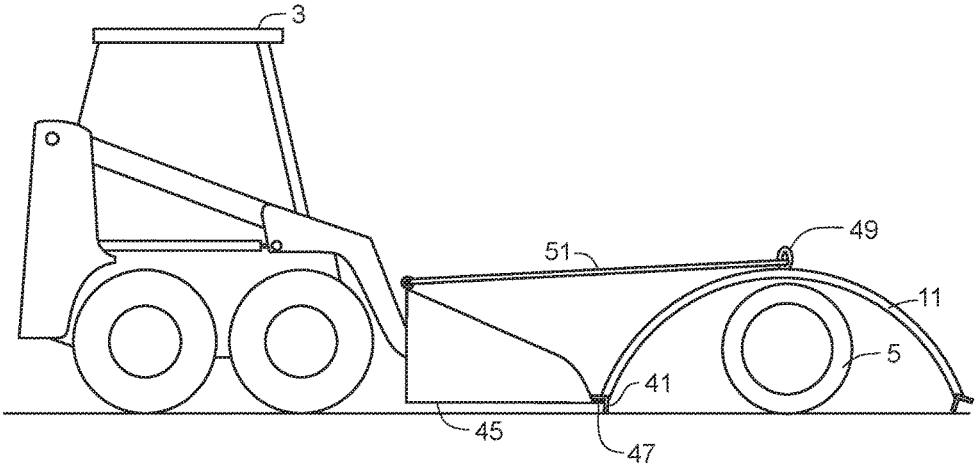
FIG. 7F is a representation of a movable bucket of a piece of construction equipment engaging with a bridge span and an attached elongated member after lowering the movable bucket.

The construction equipment 3 may navigate bridge span 7 over an obstacle 5. FIG. 7E shows a piece of construction equipment 3 that has been navigated such that bridge span 7 is positioned above obstacle 5. The construction equipment 3 may then place the bridge span 7 across an obstacle 5. The first end 13 may be placed on a ground surface 55 on one side of the obstacle 5. The second end 15 may be placed on a ground surface 55 on the other side of the obstacle 5. In some embodiments, the construction equipment 3 places the bridge span 7 by lowering the movable bucket 45, as shown in FIG. 7F.

Figure 7G:
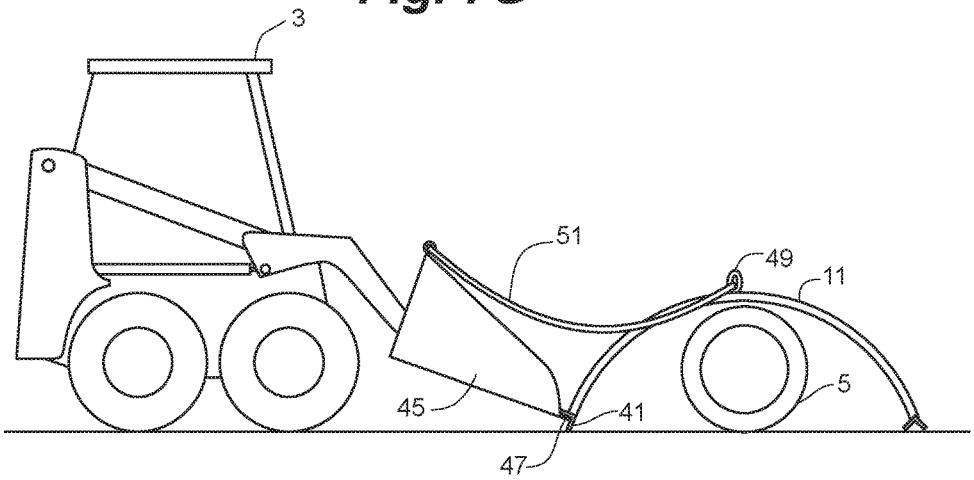
FIG. 7G is a representation of a movable bucket of a piece of construction equipment engaging with a bridge span and an attached elongated member after releasing tension in the elongated member.
Figure 7H:
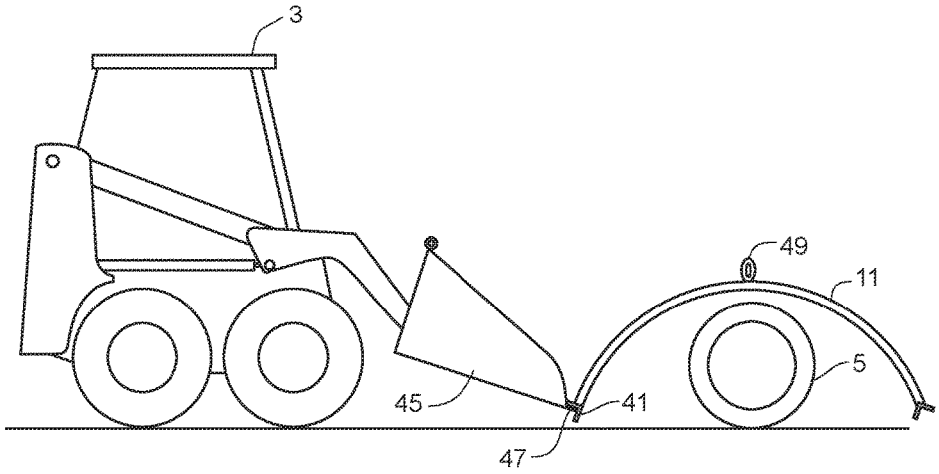
FIG. 7H is a representation of a movable bucket of a piece of construction equipment engaging with a bridge span in position over an obstacle after removing an elongate member.
Figure 7I:
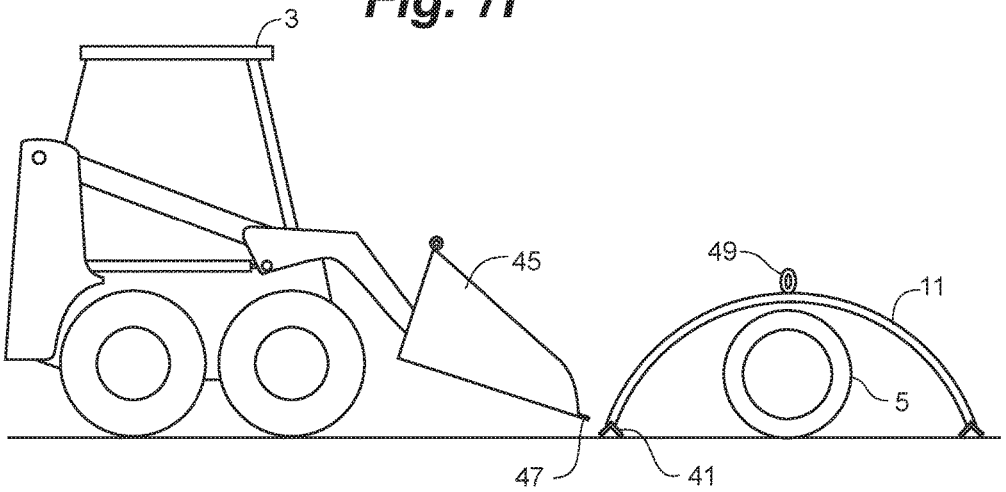
FIG. 7I is a representation of a movable bucket of a piece of construction equipment disengaged with a bridge span in position over an obstacle.

Once the bridge span 7 is in place, the construction equipment 3 may be disengaged from the bridge span 7. Prior to disengagement, tension may be released in the elongate member 51 in the elongated member, for example by tipping the movable bucket as shown in FIG. 7G. Upon releasing tension in elongate member 51, second end 15 may be lowered near or on ground surface 55 on the other side of the obstacle 5 Disengagement may be accomplished by decoupling the elongated member 51 from either the coupling joint 49 or the construction equipment 3, as shown in FIG. 7H. Disengagement may further be accomplished by decoupling the movable bucket 45 from the stabilizing member 41, a shown in FIG. 7I. This enhances the utility of construction equipment 3 by enabling the operator to deploy a bridge span 7 without assistance.

Figure 7J:
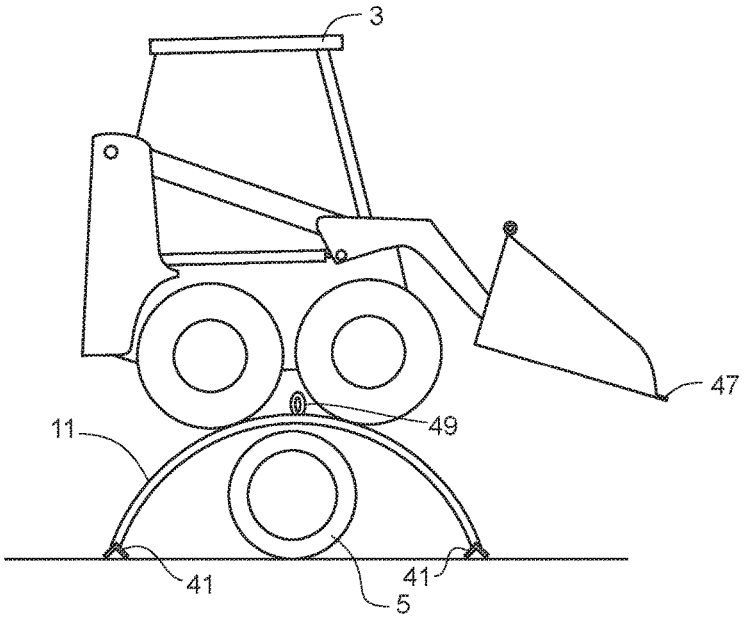
FIG. 7J is a representation of a movable bucket of a piece of construction equipment crossing an obstacle using a bridge span assembly.

The construction equipment 3 may cross the bridge span assembly 1 via a curved deck surface 20 or angled deck surface 30 once all bridge spans 7 of a bridge span assembly 1 is in place. FIGS. 1 and 7J depict a piece of construction equipment 3 using a deployed bridge span assembly 1 to cross an obstacle 5. Deploying a bridge span assembly 1 enables construction equipment 3 to access some otherwise inaccessible worksites. Deploying a bridge span assembly 1 also enables construction equipment 3 to access some worksites without damaging existing structures or landscape features. According to some embodiments, an obstacle 5 may be a sidewalk or a channel. Using a bridge span assembly 1 reduces the delay required for construction equipment 3 to enter a worksite that is blocked by an obstacle, existing structure, or existing landscape feature.

Various examples have been described. These and other examples are within the scope of the following claims.

The invention claimed is:

1. A method of crossing a sidewalk with a skid loader without engaging the sidewalk, comprising:

(a) providing a bridge span assembly that includes at least two bridge spans, each bridge span including a frame extending from a first end to a second end and having a curved or angled deck surface, a v-shaped flange attached to the frame near the first end of the frame, and a coupling joint attached to the frame;

(b) engaging each bridge span with the skid loader, including engaging the v-shaped flange with a lip of a movable bucket of the skid loader and coupling a fixed length of chain to the skid loader and to the coupling joint;

(c) lifting each bridge span with the skid loader by maintaining tension in the fixed length of chain and lifting the first end of the frame by lifting the skid loader's movable bucket and thus the v-shaped flange;

(d) placing each bridge span across the sidewalk by placing the first end on a ground surface on one side of the sidewalk and the second end on a ground surface on the other side of the sidewalk;

(e) disengaging each bridge span from the skid loader, including decoupling the fixed length of chain from the skid loader and/or the coupling joint and disengaging the lip of the movable bucket from the v-shaped flange; and (f) driving the skid loader across the bridge span assembly, the skid loader contacting the deck surface.

2. The method of claim 1, wherein the frame has a curved deck surface.

3. The method of claim 2, wherein the curved deck surface comprises a curved sheet of a material.

4. The method of claim 2, wherein the curved deck surface comprises first and second curved rods and a plurality of straight rods, configured such that the first and second curved rods are parallel to each other and connected to each other by the plurality of straight rods.

5. The method of claim 1, wherein the frame has an angled deck surface comprising first and second rods each with a plurality of linear angled sections and a plurality of straight rods, configured such that the first and second rods are parallel to each other and connected to each other by the plurality of straight rods, each straight rod attaching to the first and second rods at a juncture of two of the linear angled sections.

6. The method of claim 1, wherein the coupling joint is nearer to the second end of the frame than to the first end of the frame.

7. The method of claim 1, further comprising a pad attached to each end of the frame.

8. The method of claim 1, further comprising a deck surface with a non-slip coating or material.

9. The method of claim 1, wherein the bridge span assembly includes a first bridge span and a second bridge span, and wherein engaging, lifting, placing, and disengaging the first bridge span occurs before engaging, lifting, placing, and disengaging the second bridge span.

* * * * *